US009605676B2

(12) United States Patent
Ignatiev et al.

(10) Patent No.: US 9,605,676 B2
(45) Date of Patent: Mar. 28, 2017

(54) VARIABLE SPEED SCROLL COMPRESSOR

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 423 days.

(21) Appl. No.: 14/282,323

(22) Filed: May 20, 2014

(65) Prior Publication Data

US 2014/0356209 A1 Dec. 4, 2014

Related U.S. Application Data

(60) Provisional application No. 61/829,598, filed on May 31, 2013.

(51) Int. Cl.

| | |
|---|---|
| ***F04C 29/00*** | (2006.01) |
| ***F04C 18/02*** | (2006.01) |
| *F04C 23/00* | (2006.01) |
| *F04C 29/02* | (2006.01) |

(52) U.S. Cl.

CPC ..... *F04C 29/0057* (2013.01); *F04C 18/0215* (2013.01); *F04C 23/008* (2013.01); *F04C 29/023* (2013.01); *F04C 2240/807* (2013.01)

(58) Field of Classification Search

CPC ..... F04C 29/0057; F04C 18/0207; F04C 2230/605

USPC ..... 418/55.5

See application file for complete search history.

(56) References Cited

U.S. PATENT DOCUMENTS

| | | | |
|---|---|---|---|
| 4,413,959 | A | 11/1983 | Butterworth |
| 4,439,118 | A | 3/1984 | Iimori |
| 4,730,998 | A | 3/1988 | Kakuda et al. |
| 5,240,386 | A | 8/1993 | Amin et al. |
| 5,295,813 | A | 3/1994 | Caillat et al. |
| 5,320,506 | A | 6/1994 | Fogt |
| 5,437,543 | A | 8/1995 | Goto et al. |

(Continued)

FOREIGN PATENT DOCUMENTS

| | | | |
|---|---|---|---|
| CN | 201396285 | Y | 2/2010 |
| CN | 102486174 | A | 6/2012 |

(Continued)

OTHER PUBLICATIONS

JP47549162B2 Auther: Takasu Hirosato, ; Mizuno Hisao, ; Matsuda Susumu, ; Sato So; English Translation Attached.*

(Continued)

*Primary Examiner* — Kenneth Bomberg
*Assistant Examiner* — Anthony Ayala Delgado
(74) *Attorney, Agent, or Firm* — Harness, Dickey & Pierce, P.L.C.

(57) ABSTRACT

A compressor is provided and may include a driveshaft and an orbiting scroll member driven by the driveshaft. The orbiting scroll member may include an end plate, a spiral wrap extending from the end plate, and a chamber formed by the orbiting scroll member and disposed on an opposite side of the end plate than the spiral wrap. A counterweight may be fixed for rotation with the driveshaft and may be received within the chamber of the orbiting scroll member.

21 Claims, 7 Drawing Sheets

(56) References Cited

U.S. PATENT DOCUMENTS

| | | | | |
|---|---|---|---|---|
| 5,562,436 | A * | 10/1996 | Kawahara | F04C 29/0057 418/55.5 |
| 2004/0136854 | A1 * | 7/2004 | Kimura | F04C 23/008 418/55.4 |
| 2004/0170509 | A1 * | 9/2004 | Wehrenberg | F04C 29/045 417/371 |

FOREIGN PATENT DOCUMENTS

| | | | | |
|---|---|---|---|---|
| CN | 204239239 | U | 4/2015 | |
| EP | 924432 | A1 | 6/1999 | |
| JP | H07109984 | A | 4/1995 | |
| JP | 2005233043 | A | 9/2005 | |
| JP | 4754916 | B2 * | 8/2011 | F04C 18/0276 |

OTHER PUBLICATIONS

Office Action regarding Chinese Patent Application No. 201410240959.2, dated Dec. 30, 2015. Translation provided by Unitalen Attorneys at Law.

* cited by examiner

VARIABLE SPEED SCROLL COMPRESSOR

CROSS-REFERENCE TO RELATED APPLICATIONS

This application claims the benefit of U.S. Provisional Application No. 61/829,598, filed on May 31, 2013. The entire disclosure of the above application is incorporated herein by reference.

FIELD

The present disclosure relates to a scroll compressor and more particularly to a high-side, variable-speed scroll compressor incorporating a two-piece orbiting scroll member.

BACKGROUND

This section provides background information related to the present disclosure which is not necessarily prior art.

Scroll compressors are used in applications such as refrigeration systems, air conditioning systems, and heat pump systems to pressurize and, thus, circulate refrigerant within each system.

As the scroll compressor operates, an orbiting scroll member having an orbiting scroll member wrap orbits with respect to a non-orbiting scroll member having a non-orbiting scroll member wrap to make moving line contacts between flanks of the respective scroll wraps. In so doing, the orbiting scroll member and the non-orbiting scroll member cooperate to define moving, crescent-shaped pockets of vapor refrigerant. A volume of the fluid pockets decreases as the pockets move toward a center of the scroll members, thereby compressing the vapor refrigerant disposed therein from a suction pressure to a discharge pressure.

Two types of contacts define the fluid pockets formed between the orbiting scroll member and the non-orbiting scroll member, and create forces therebetween. Namely, radial or flank forces are created by axially extending tangential line contacts between spiral faces or flanks of the scroll wraps and axial forces are created by area contacts between the planar edge surfaces, or tips, of each scroll wrap and an opposing end plate of the other scroll member. While such forces are easily managed in a fixed-speed compressor, flank forces can be a source of undesirable fluid leakage and sound that is difficult to manage in a variable-speed compressor. Undesirable sound and frictional efficiency losses are experienced at higher speeds in the variable-speed compressor, particularly in radially compliant variable-speed scroll compressors. Such radially compliant scroll compressors incorporate an unloader bushing for allowing the flanks of the orbiting scroll to disengage the flanks of the non-orbiting scroll. Such radial compliant scroll compressors are described in U.S. Pat. No. 5,295,813.

SUMMARY

This section provides a general summary of the disclosure, and is not a comprehensive disclosure of its full scope or all of its features.

A compressor is provided and may include a driveshaft and an orbiting scroll member driven by the driveshaft. The orbiting scroll member may include an end plate, a spiral wrap extending from the end plate, and a chamber formed by the orbiting scroll member and disposed on an opposite side of the end plate than the spiral wrap. A counterweight may be fixed for rotation with the driveshaft and may be received within the chamber of the orbiting scroll member.

In another configuration, a compressor is provided and may include a driveshaft and an orbiting scroll member driven by the driveshaft. The orbiting scroll member may include a first member having an end plate and a spiral wrap extending from the end plate and a second member having a hub portion, a wall portion, and a base portion extending between and connecting the wall portion and the hub portion, whereby the base portion opposes the end plate and defines a chamber therebetween. A counterweight may be fixed for rotation with the driveshaft and may be received within the chamber of the orbiting scroll member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
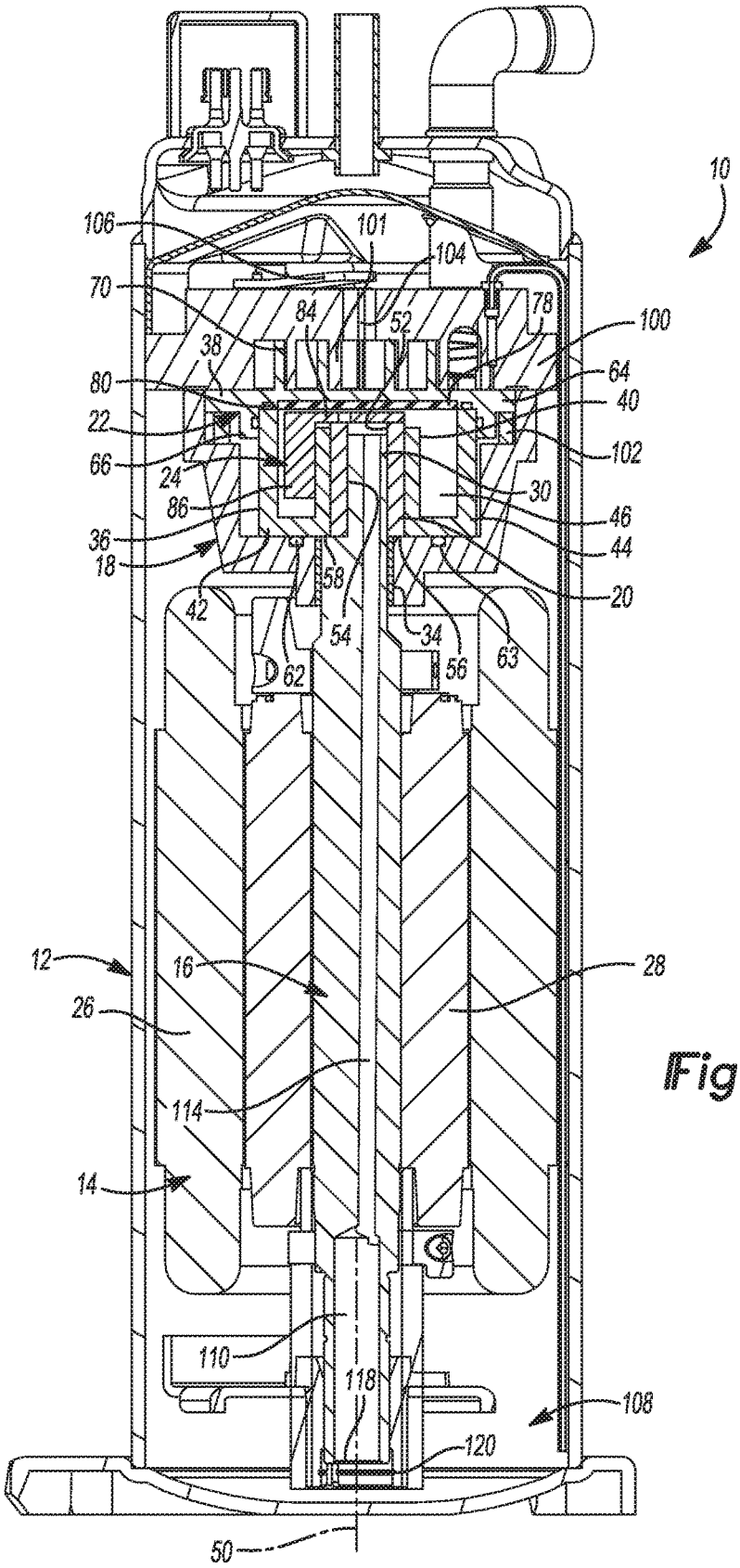
FIG. 1 is a cross-sectional view of a compressor in accordance with the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a compressor 10 is shown and may include a generally cylindrical hermetic shell 12, a motor 14, a driveshaft 16, a main bearing housing 18, a bushing 20, an orbiting scroll member 22, and a counterweight 24.

The motor 14 may be disposed within the hermetic shell 12, and may include a stator 26 and a rotor 28. The stator 26 may be fixedly supported by the hermetic shell 12. The motor 14 and associated stator 26 and rotor 28 cooperate to rotate the driveshaft 16 relative to the hermetic shell 12 to compress a fluid from a suction pressure to a discharge pressure.

The driveshaft 16 may include an eccentric pin 30 mounted to, or integrally formed with, a first end 32 thereof. The eccentric pin 30 may include a substantially planar surface 48 extending parallel to the rotational axis 50 of the driveshaft 16. A portion of the driveshaft 16 may be supported by a bearing 34 provided in the main bearing housing 18.

Figure 6:
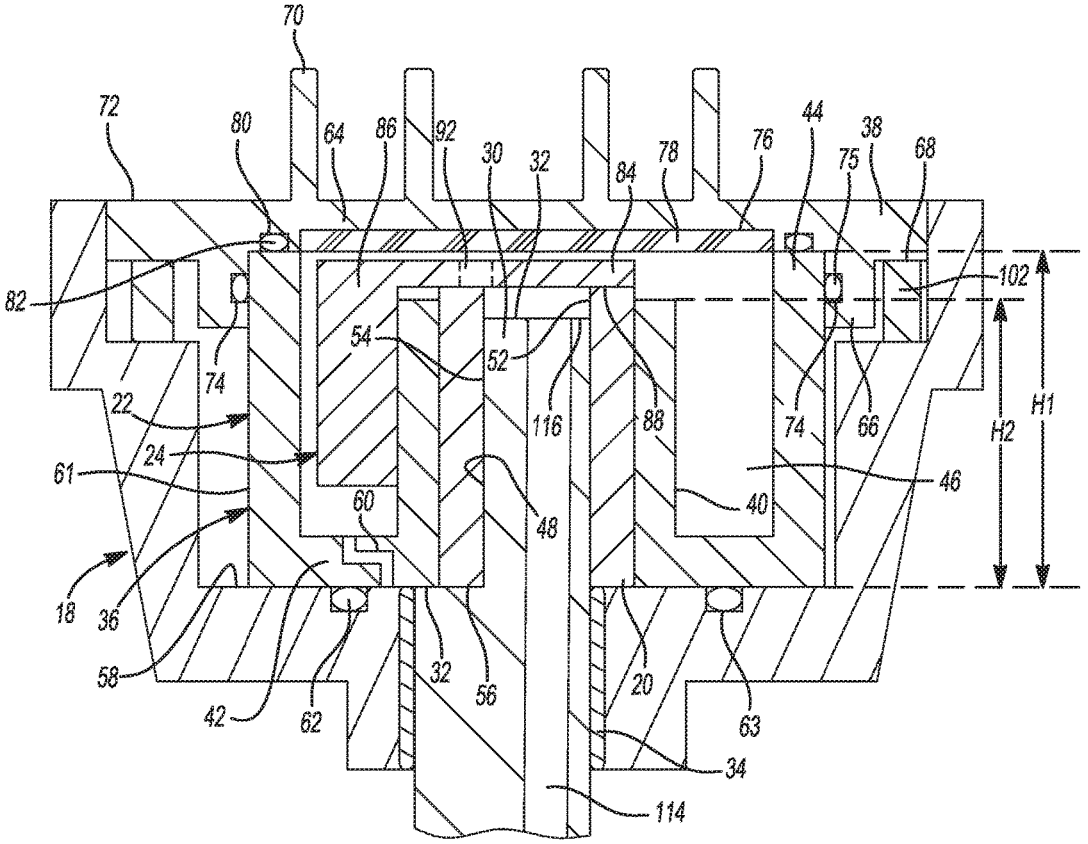
FIG. 6 is a partial cross-sectional view of the compressor in FIG. 1.

The orbiting scroll member 22 may include a first orbiting member 36 and a second orbiting member 38. The first orbiting member 36 may include a hub portion 40, a base portion 42, and an outer wall portion 44. A height H1 of the outer portion 44 may be greater than a height H2 of the hub portion 40, as shown in FIG. 6. The first orbiting member 36 may cooperate with the second orbiting member 38 to form a chamber 46 therebetween.

The bushing 20 may be provided between the eccentric pin 30 and the hub portion 40 of the first orbiting member 36. The bushing 20 may include a substantially D-shaped longitudinal hole 52 extending parallel to the rotational axis 50 of the driveshaft 16. The longitudinal hole 52 may include a substantially planar surface 54 that provides the longitudinal hole 52 with the "D" shape. The eccentric pin 30 may be coupled to the longitudinal hole 52 via engagement between the planar surface 54 of the longitudinal hole 52 and the planar surface 48 of the eccentric pin 30.

The hub portion 40 of the first orbiting member 36 may be rotatably coupled to the bushing 20, such that the orbiting scroll member 22 orbits about a rotational axis 50 of the driveshaft 16 upon rotation of the motor 14. A bearing (not shown) may be disposed between the hub portion 40 and the bushing 20. A first end 56 of the bushing 20 may be axially supported by at least one of the first end 32 of the driveshaft 16 and the main bearing housing 18. The bushing 20 may support the first orbiting member 36 in a radial direction.

The base portion 42 of the first orbiting member 36 may be axially supported by a support surface 58 of the main bearing housing 18. The base portion 42 of the first orbiting member 36 may include a passageway 60 extending therethrough. As will be described below, the passageway 60 may be an oil drain that transfers oil or other fluids from the chamber 46 to the bearing 34. A seal 62 may be provided between the main bearing housing 18 and the base portion 42 to seal the bearing 34 from an outer surface 61 (FIG. 6) of the first orbiting member 36. The seal 62 may be an annular ring seal, and may be disposed within a channel 63 (FIG. 1) provided in the support surface 58 of the main bearing housing 18.

The second orbiting member 38 may be axially and radially supported by the first orbiting member 36. The second orbiting member 38 may include an end plate 64, an annular hub 66 extending from a first side 68 of the end plate 64, and a spiral wrap 70 extending from a second side 72 of the end plate 64. In one configuration, a groove 74 may be provided in at least one of the hub 66 and the outer portion 44 of the first orbiting member 36. A snap ring 75 may be provided in the groove 74 to couple the first orbiting member 36 to the second orbiting member 38 such that the first orbiting member 36 is fixed for movement with the second orbiting member 38. While a snap ring 75 is disclosed, the first orbiting member 36 may be coupled to the second orbiting member 38 by other methods generally known in the art, such as a weld, a threaded connection, or a press-fit.

Figure 3:
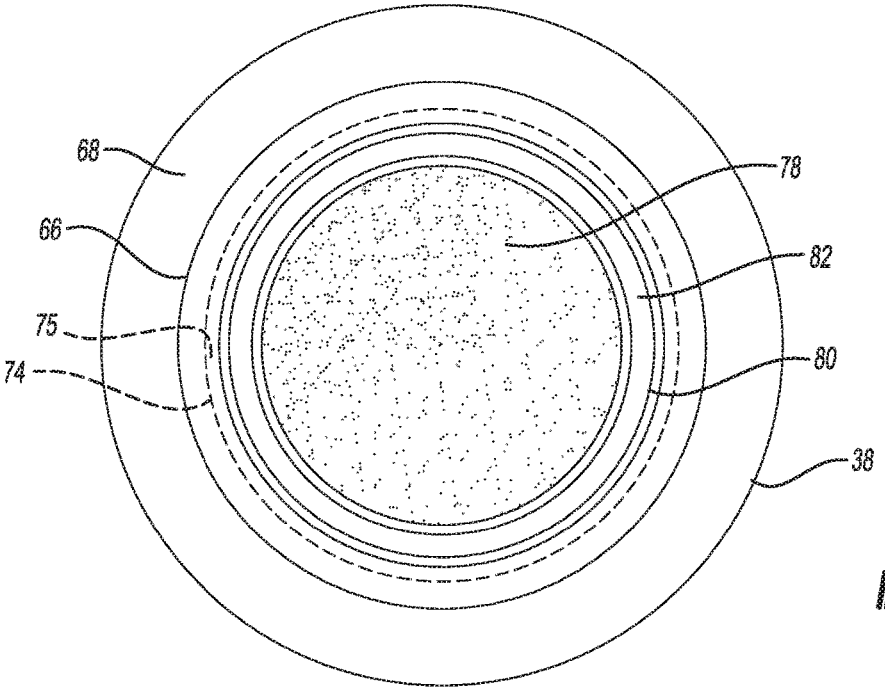
FIG. 3 is a bottom view of the compressor in FIG. 1, showing a second member of an orbiting scroll member.
Figure 4:
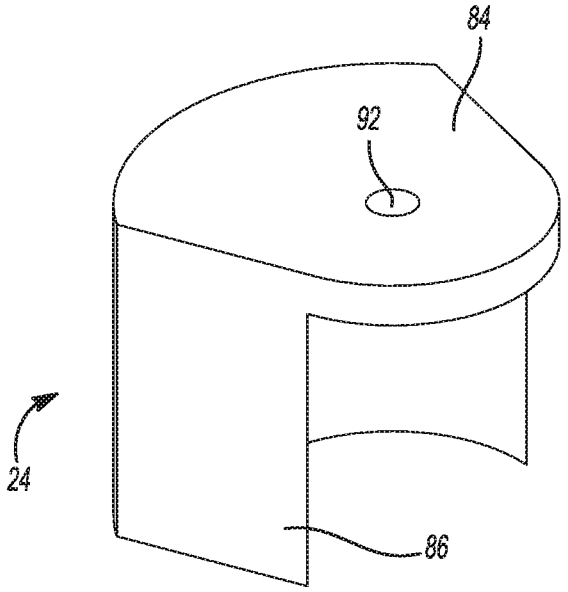
FIG. 4 is a perspective view of a counterweight of the compressor in FIG. 1.
Figure 5:
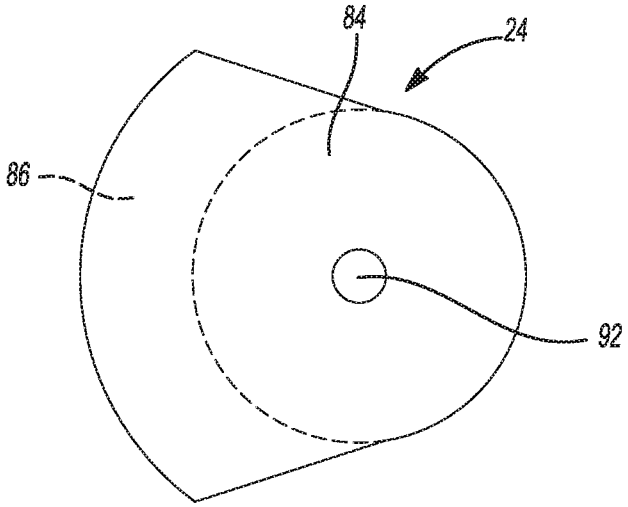
FIG. 5 is a top view of the counterweight in FIG. 4.

With reference to FIG. 6, the first side 68 of the second orbiting member 38 may also include a first recessed portion 76. The first recessed portion 76 may support an insulation element 78 of similar size to the first recessed portion 76. In one configuration, the first recessed portion 76 and the insulation element 78 are circular and generally concentrically located with respect to the second orbiting member 38 (FIG. 3). A second recessed portion 80 may be provided in at least one of the first side 68 of the second orbiting member 38 and the outer portion 44 of the first orbiting member 36. The second recessed portion 80 may support a seal element 82 that seals the chamber 46 from the outer surface 61 of the first orbiting member 36.

Figure 2:
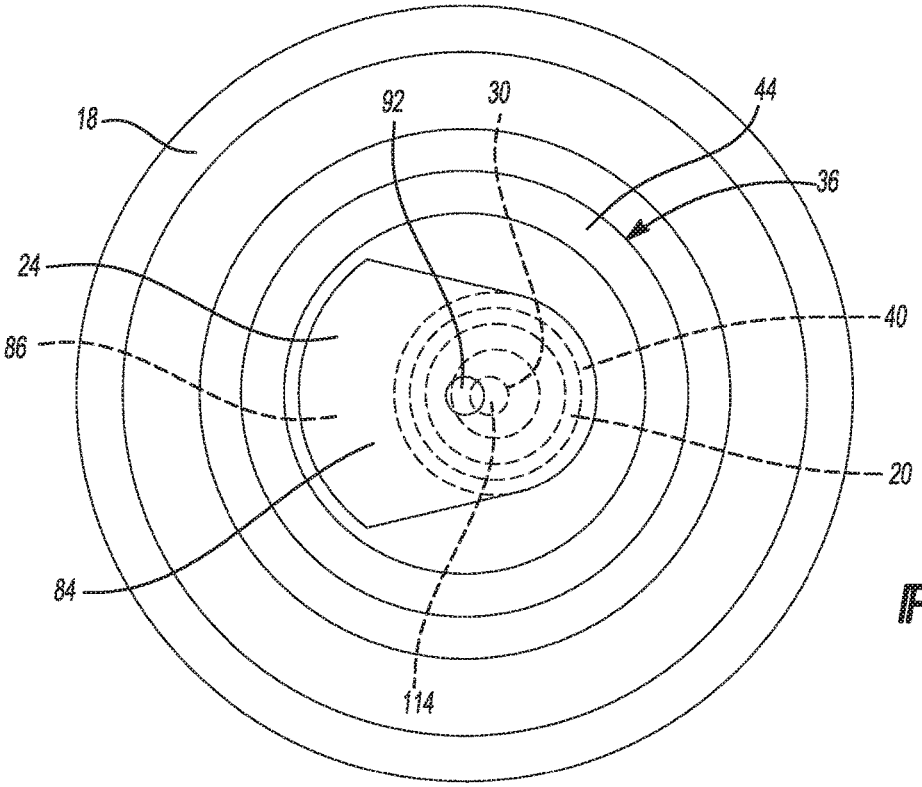
FIG. 2 is a top view of the compressor in FIG. 1, showing an eccentric pin, a bushing, and a first member of an orbiting scroll member.

With particular reference to FIGS. 2 and 6, the counterweight 24 is shown as being coupled to the bushing 20. The counterweight 24 may include a connecting arm 84 and a counterweight arm 86. The connecting arm 84 may be coupled to the counterweight arm 86 by welding, mechanical fasteners, or other fastening systems generally known in the art. It is also contemplated that the connecting arm 84 and counterweight arm 86 may be integrally formed from a single piece of material.

The connecting arm 84 may be coupled to a second end 88 of the bushing 20 by welding, mechanical fasteners, or other fastening systems known in the art. The connecting arm 84 may include an aperture 92 to permit fluid communication between the chamber 46 and the central portion 90 of the bushing 20. The counterweight arm 86 may be disposed within the chamber 46, and may extend from the connecting arm 84 in a direction substantially parallel to the rotational axis 50 of the driveshaft 16, such that the counterweight 24 is able to rotate with the bushing 20 upon rotation of the driveshaft 16 by the motor 14.

The counterweight arm 86 may extend from the connecting arm 84 with a variety of profiles, including but not limited to, a circular cross-section and a cross-section that at least partially encircles the hub portion 40 of the first orbiting member 36. The shape of the counterweight arm 86 is not limited to the shape shown in the figures. Rather, the shape and position of the center of gravity of the counterweight 24 can be designed and modified based on the positional relationship of other components of the compressor 10. For example, a length and/or thickness of the connecting arm 84 may be reduced and a length and/or thickness of the counterweight arm 86 may be increased, or vice versa, in order to affect the center of gravity of the counterweight 24.

With reference to FIGS. 7-10, a second configuration of an orbiting scroll member 22' is provided. The orbiting scroll member 22' is generally similar to the orbiting scroll member 22. Accordingly, like reference numerals are used hereinafter and in the drawings to identify like components while like reference numerals containing an apostrophe (') are used to identify those components that have been modified.

Figure 10:
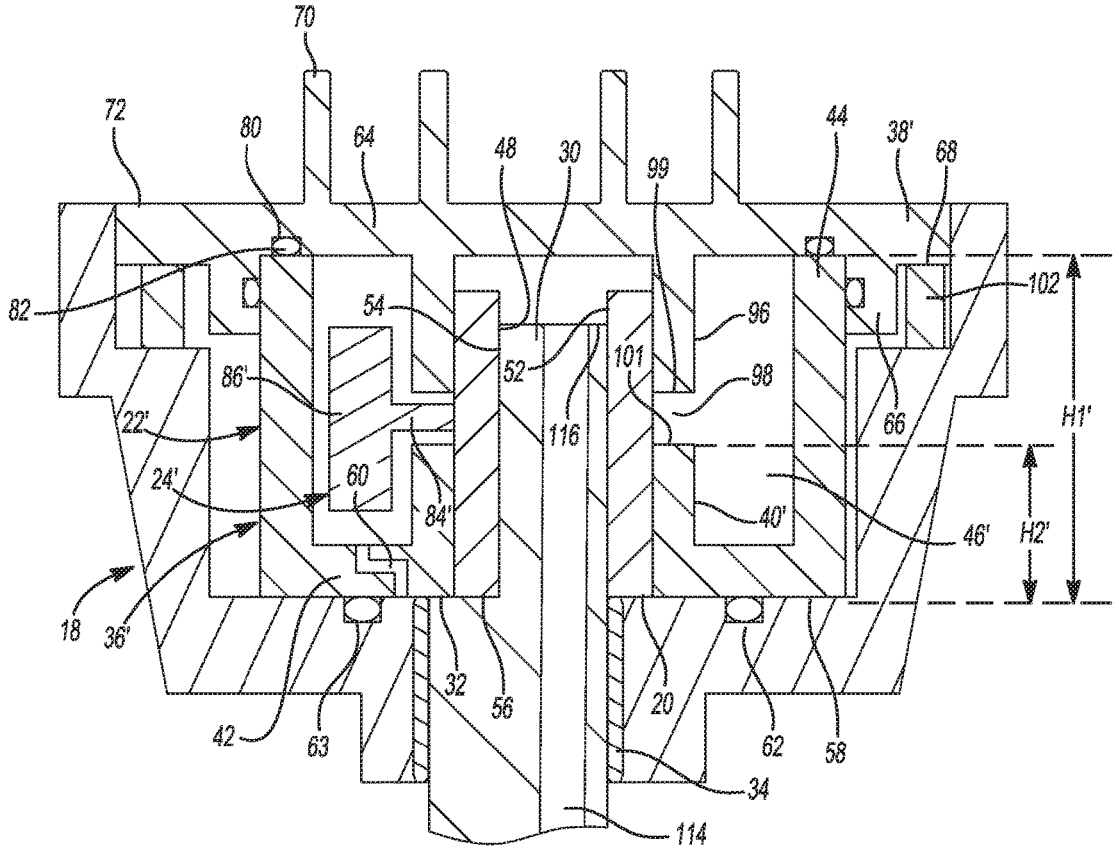
FIG. 10 is a partial cross-sectional view of the compressor in FIG. 6.

The orbiting scroll member 22' may include a first orbiting member 36' and a second orbiting member 38'. The first orbiting member 36' may include a hub portion 40', a base portion 42', and an outer portion 44', cooperating to form a chamber 46'. A height H1' of the outer portion 44' may be greater than a height H2' of the hub portion 40', as shown in FIG. 10.

The second orbiting member 38' may be axially and radially supported by at least one of the first orbiting member 36' and the bushing 20. The first side 68 of the end plate 64 of the second orbiting member 38' may include an inner hub 96. The inner hub 96 may be coaxially and rotatably mounted on the bushing 20, so as to define a gap 98 between a bottom surface 99 of the inner hub 96 and a top surface 101 of the hub portion 40 of the first orbiting member 36'.

Figure 8:
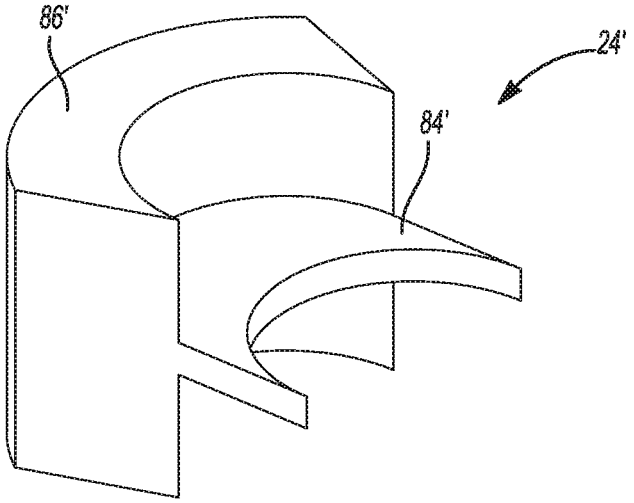
FIG. 8 is a perspective view of a counterweight of the compressor in FIG. 7.
Figure 9:
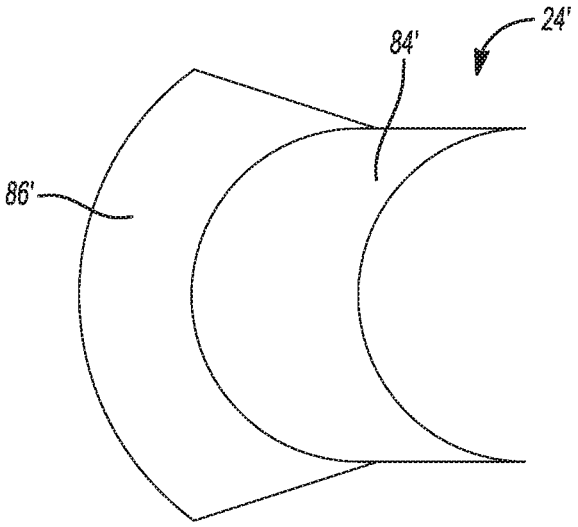
FIG. 9 is a top view of the counterweight in FIG. 8.

With particular reference to FIGS. 8 and 9, a counterweight 24' may include a connecting arm 84' and a counterweight arm 86'. The connecting arm 84' may extend through the gap 98 formed between the hub portion 40 of the first orbiting member 36' and the inner flange 96 of the second orbiting member 38' to allow the connecting arm 84' to be coupled to the bushing 20. The connecting arm 84' may extend from the bushing 20 in a direction substantially perpendicular to the rotational axis 50 of the driveshaft 16. The counterweight arm 86' may be disposed within the chamber 46', and may extend from the connecting arm 84' in a direction substantially parallel to the rotational axis 50 of the driveshaft 16, such that the counterweight 24' rotates with the bushing 20 upon rotation of the driveshaft 16 by the motor 14.

The counterweight arm 86' may extend from the connecting arm 84' with a variety of profiles, including but not limited to, a circular cross-section and a cross-section that at least partially encircles the hub portion 40 of the first orbiting member 36'. The counterweight arm 86' may also extend from the connecting arm 84' in a variety of directions. The shape of the counterweight arm 86' is not limited to the shape shown in the figures. Rather, the shape and position of the center of gravity of the counterweight 24' can be designed and modified based on the positional relationship of other components of the compressor 10. For example, a length and/or thickness of the connecting arm 84' may be reduced and a length and/or thickness of the counterweight arm 86' may be increased, or vice versa, in order to affect the center of gravity of the counterweight 24'.

Figure 7:
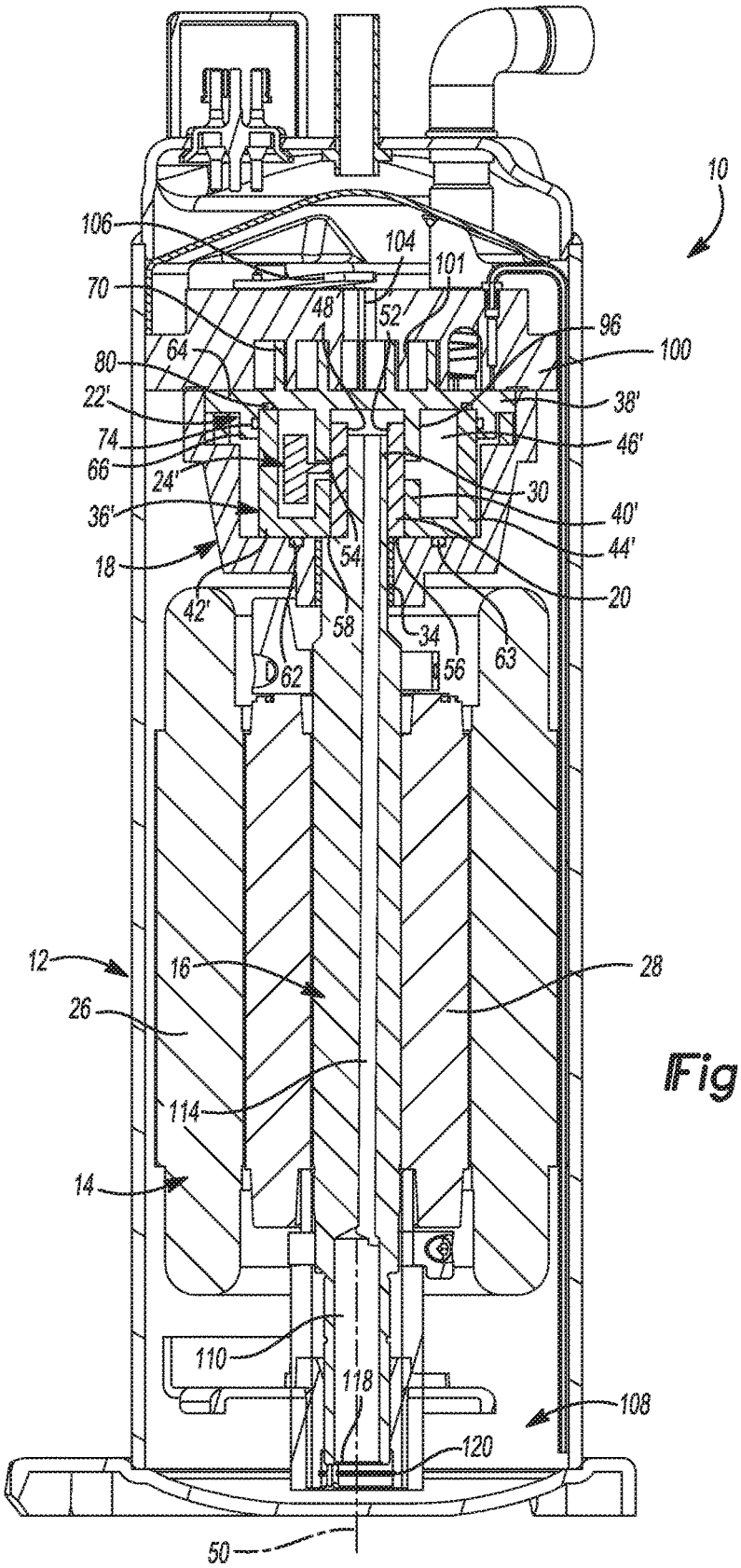
FIG. 7 is a cross-sectional view of another configuration of the compressor in FIG. 1.

With particular reference to FIGS. 1 and 7, the orbiting scroll member 22 may orbit relative to a non-orbiting scroll member 100 (i.e. a central axis of the orbiting scroll member 22 rotates around a central axis of the non-orbiting scroll member 100, however the orbiting scroll member 22 does not rotate around its own central axis) by rotating with respect to the bushing 20, so as to compress a working fluid (not shown). An Oldham coupling 102 is disposed generally between the orbiting scroll member 22 and the main bearing housing 18. The Oldham coupling 102 is keyed to the orbiting scroll member 22 and the non-orbiting scroll member 100, and transmits rotational forces from the driveshaft 16 to the orbiting scroll member 22 to compress the fluid disposed generally between the spiral wrap 70 of the orbiting scroll member 22 and a spiral wrap 101 of the non-orbiting scroll member 100.

The Oldham coupling 102, and its interaction with the orbiting scroll member 22 and the non-orbiting scroll member 100, is preferably of the type disclosed in assignee's commonly owned U.S. Pat. No. 5,320,506, the disclosure of which is incorporated herein by reference. The fluid compressed by the non-orbiting scroll member 100 and the orbiting scroll member 22 may be discharged from the compressor 10 via a discharge port 104 provided in the non-orbiting scroll member 100. A one-way valve or a discharge valve 106 may be provided at the discharge port 104 to restrict or prevent the discharged fluid from flowing back into the compressor 10 via the discharge port 104.

Operation of the compressor 10 will now be described in detail. Lubricant may be stored at a bottom portion 108 of the hermetic shell 12 of the compressor 10. The driveshaft 16 may include a central hole 110 formed at a lower end 112 thereof and an eccentric hole 114 extending upwardly from the central hole 110 to an end surface 116 of the eccentric pin 30. An end portion 118 of the central hole 110 may be immersed in the lubricant at the bottom portion 108 of the hermetic shell 12 of the compressor 10 or may be supplied with lubricant in another manner.

In one example, a lubricant supplying device 120, for example an oil pump or an oil flinger as shown in FIGS. 1 and 7, may be provided in the central hole 110 or at the end portion 118 of the central hole 110. During operation of the compressor 10, one end of the central hole 110 is supplied with lubricant by the lubricant supplying device 120. Under the action of the centrifugal force generated by the rotation of the driveshaft 16, the lubricant that enters the driveshaft 16 in the central hole 110 is pumped into the eccentric hole 114 and then flows upwardly to the end surface 116 of the eccentric pin 30 along the eccentric hole 114.

The lubricant discharged from the end surface 116 of the eccentric pin 30 may flow upwardly through the aperture 92 in the connecting arm 84 and fill the chamber 46. Oil in the chamber 46 may flow (i) downwardly through the passageway 60 in the base portion 42 of the first orbiting member 36, where it may be spread between the main bearing housing 18 and the base portion 42 of the first orbiting member 36 by the orbiting movement of the orbiting scroll member 22, and (ii) downwardly through the joint between the bushing 20 and the hub portion 40 of the first orbiting member 36. Oil disposed between the main bearing housing 18 and the base portion 42 of the first orbiting member 36, and oil disposed between the bushing 20 and the hub portion 40 of the first orbiting member 36, may flow downwardly along the driveshaft 16 and into the bottom portion 108 of the hermetic shell 12 of the compressor 10. Once the oil has reached the bottom portion 108 of the hermetic shell 12, the lubrication process may begin again, as the oil is pumped or otherwise transported upwardly through the central hole 110 of the driveshaft 16.

As the eccentric pin 30 rotates with the driveshaft 16, thereby causing the bushing 20 to rotate, the counterweight 24 may rotate with the bushing 20 and offset, or balance, the centrifugally-generated radial forces between the spiral wrap 70 of the orbiting scroll member 22 and the spiral wrap 101 of the non-orbiting scroll member 100, thereby allowing the orbiting scroll member 22 to orbit smoothly relative to the non-orbiting scroll member 100 as the speed of the motor 14 varies. Specifically, during operation of the compressor 10, the orbiting scroll member 22 may orbit relative to the non-orbiting scroll member 100 and generate a centrifugal force. The eccentric pin 30 of the driveshaft 16 may also generate a driving force component which may facilitate radial sealing and radial contact forces between the non-orbiting scroll member 100 and the orbiting scroll member 22. Due to the above centrifugal forces and the driving force component, the spiral wrap 70 of the orbiting scroll member 22 may abut against the spiral wrap 101 of the non-orbiting scroll member 100, thereby ensuring radial sealing between the non-orbiting scroll member 100 and the orbiting scroll member 22. Because the counterweight 24 may rotate around the hub portion 40 of the first orbiting member 36, the counterweight 24 may generate a centrifugal force that is able to offset and balance the radial contact forces between the non-orbiting scroll member 100 and the orbiting scroll member 22.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a driveshaft;

an orbiting scroll member driven by said driveshaft and including a first member and a second member that are separate components, said first member including an end plate and a spiral wrap extending from said end plate, said first member and said second member cooperating to form a chamber therebetween, said chamber being disposed on an opposite side of said end plate than said spiral wrap; and a counterweight fixed for rotation with said driveshaft and received within said chamber of said orbiting scroll member.

2. The compressor of claim 1, wherein said second member has a hub portion, a wall portion, and a base portion extending between and connecting said wall portion and said hub portion, said base portion opposing said end plate and defining a chamber therebetween.

3. A compressor comprising:

a driveshaft;

an orbiting scroll member driven by said driveshaft and including an end plate, a spiral wrap extending from said end plate, a hub portion, and a chamber formed by said orbiting scroll member and disposed on an opposite side of said end plate than said spiral wrap;

a bushing disposed between said hub portion and said driveshaft; and a counterweight fixed for rotation with said driveshaft via said bushing and received within said chamber of said orbiting scroll member, wherein said counterweight includes a first portion attached to said bushing, a second portion extending from said first portion and info said chamber in a direction away from said end plate, and a third portion extending from said first portion, into said chamber, and in a direction toward said end plate.

4. A compressor comprising:

a driveshaft;

an orbiting scroll member driven by said driveshaft and including a first member having an end plate and a spiral wrap extending from said end plate and a second member having a hub portion, a wall portion, and a base portion extending between and connecting said wall portion and said hub portion, said base portion opposing said end plate and defining a chamber therebetween; and a counterweight fixed for rotation with said driveshaft and received within said chamber of said orbiting scroll member.

5. The compressor of claim 4, further comprising a bushing disposed between said hub portion and said driveshaft, said counterweight fixed for rotation with said driveshaft via said bushing.

6. The compressor of claim 5, wherein said counterweight includes a first portion attached to said bushing and a second portion extending from said first portion and into said chamber in a direction away from said end plate.

7. The compressor of claim 6, wherein said first portion is attached to a distal end of said bushing and said bushing is attached at a distal end of said driveshaft.

8. The compressor of claim 6, wherein said first portion is attached to an outer surface of said bushing along a length of said bushing between a first end and a second end, said bushing being attached to said driveshaft at a distal end of said driveshaft.

9. The compressor of claim 8, wherein said counterweight includes a third portion extending from said first portion, into said chamber, and in a direction toward said end plate.

10. The compressor of claim 4, wherein said wall portion extends from said base portion toward said first member by a greater extent than said hub portion.

11. The compressor of claim 4, further comprising at least one seal at a junction of said wall portion and said first member.

12. The compressor of claim 4, further comprising a passageway formed through said base portion, said passageway operable to permit fluid to drain from said chamber.

13. The compressor of claim 4, further comprising a recess formed in said end plate on an opposite side of said end plate than said spiral wrap, said recess receiving an insulation element therein.

14. The compressor of claim 4, wherein said first member and said second member are separate components.

15. The compressor of claim 1, wherein said second member defines a hub portion.

16. The compressor of claim 15, further comprising a bushing disposed between said hub portion and said driveshaft, said counterweight fixed for rotation with said driveshaft via said bushing.

17. The compressor of claim 16, wherein said counterweight includes a first portion attached to said bushing and a second portion extending from said first portion and into said chamber in a direction away from said end plate.

18. The compressor of claim 17, wherein said first portion is attached to a distal end of said bushing and said bushing is attached at a distal end of said driveshaft.

19. The compressor of claim 17, wherein said first portion is attached to an outer surface of said bushing along a length of said bushing between a first end and a second end, said bushing being attached to said driveshaft at a distal end of said driveshaft.

20. The compressor of claim 15, wherein said second member includes a base portion and a wall portion surrounding said hub portion and attached to said first member, said wall portion extending from said base portion of said second member toward said first member by a greater extent than said hub portion.

21. The compressor of claim 20, further comprising a passageway formed through said base portion, said passageway operable to permit fluid to drain from said chamber.

* * * * *